United States Patent [19]

Pade

[11] Patent Number: 4,458,929

[45] Date of Patent: Jul. 10, 1984

[54] AUTOMATIC LOCKING MECHANISM FOR A REVOLVING SHUTTER

[76] Inventor: Günter J. A. Pade, Mondorfstrasse 20, 6350 Bad Nauheim, Fed. Rep. of Germany

[21] Appl. No.: 279,169

[22] Filed: Jun. 30, 1981

[30] Foreign Application Priority Data

Jul. 2, 1980 [DE] Fed. Rep. of Germany ..... 3024986

[51] Int. Cl.[3] ..... E05C 3/04

[52] U.S. Cl. ..... 292/128; 160/133

[58] Field of Search ..... 160/133, 319; 292/128, 292/345

[56] References Cited

U.S. PATENT DOCUMENTS 3,102,580 9/1963 Greegor ..... 160/133

FOREIGN PATENT DOCUMENTS 2748411 3/1979 Fed. Rep. of Germany .

1359237 3/1964 France ..... 160/133

1486051 5/1967 France ..... 160/133

*Primary Examiner*—Richard E. Moore

*Attorney, Agent, or Firm*—Keil & Witherspoon

[57] ABSTRACT

The subject of the invention is an automatic locking mechanism for a revolving shutter to protect the latter against unauthorized pulling up from the outside, using a locking device which is moved into the locking position after the revolving-shutter casing has been lowered. The device has a lateral axle bearing, with a round bearing element (11) for a belt pulley (2) and a fixed square bearing pin (8) connected thereto and the end of which is designed as a round cylinder. The belt pulley (2) has an annular web **(2*a*) and the roller insertion cap (1) has an annular web (1*a*), the side webs (1*a*/2*a*) having different diameters and interlocking coaxially. A pivotable locking lever (6) engages positively through coinciding gaps. In the lowered state of the revolving-shutter casing, the lever (6) engages with the fixed bearing pin (8)** and clamps belt pulley and roller insertion cap against unauthorized turning, so that the revolving-shutter roller connected to the roller insertion cap is also locked.

6 Claims, 4 Drawing Figures

AUTOMATIC LOCKING MECHANISM FOR A REVOLVING SHUTTER

The present invention relates to an automatic locking mechanism for a revolving shutter which, by means of a locking device, protects the latter against unauthorized pulling up from outside. This locking device is moved into its locking position, more particularly to lock the revolving-shutter in position, after the revolving-shutter casing has been lowered. This locking mechanism can be used with revolving shutters of metal, wood, plastic or several combinations of such materials, and can be combined with known locking devices for securing revolving shutters in order to enhance the action of such locking devices.

A large number of locking and safety devices for revolving shutters are already known which function according to the most widely differing types of mechanisms. However, these devices generally have a complex design and are thus prone to trouble, or else their locking mechanism fails too quickly in its functional capability. Very often, they are also very expensive to purchase and to maintain. Furthermore, these devices can be installed only conditionally or not at all in every type, or at least several different types, of revolving shutters.

Published West German Patent Application No. 274 8 411 describes an automatic locking mechanism for a revolving shutter, in which the wind-up roller for the revolving-shutter casing surrounds a revolving-shutter roller (hollow axle), into which a fixed locking component extends laterally. There is installed on the revolving-shutter casing a lever which, through openings in the wind-up roller and in the revolving-shutter roller, meshes with the locking component when the revolving shutter is lowered. The fulcrum of this lever lies either at the fixing point of the level on the revolving-shutter roller or the wind-up roller.

Because the wind-up roller and the revolving-shutter roller are arranged coaxially, this design requires a minimum diameter, which considerably exceeds the diameter of a single shaft so that, when the revolving-shutter casing is wound up, the space requirement is considerable.

Accepted West German Patent Specification No. 205 9 485 discloses an automatic locking mechanism for a revolving shutter to protect it against being pulled up from the outside, by means of a locking bolt which is activated by a double-arm lever in dependence upon the wind-up position of the revolving-shutter casing. In this case, a plate having a substantially helical guide groove is connected with torsional resistance with the wind-up roller of the revolving shutter and a guide pin, arranged on the upper lever arm, engages in this groove and a lower lever arm is connected with the bolt. However, this known locking mechanism for a revolving shutter has the disadvantage that the design imposes a space requirement for the locking mechanism in addition to the revolving-shutter shaft.

The subject of West German Pat. No. 243 7 912 is an automatic locking mechanism for a revolving shutter to protect it against unauthorized pulling up from the outside by means of a locking device connected with the revolving-shutter shaft and movable into its locking position after the revolving-shutter casing is lowered, in order to mesh with the revolving-shutter casing and/or with the guide rail thereof. The characteristic feature of this locking mechanism is seen in the fact that the locking bolt is formed by one arm of a double-arm lever, which is mounted within the revolving-shutter shaft and can be moved out of it through a gap in the jacket of the revolving-shutter shaft, or that segments of the jacket of the revolving-shutter shaft are connected together in the axial direction in hinge-like fashion such that, when the revolving-shutter casing is in its down position, they swing out of the circumferential line of the shaft.

The disadvantage of this locking mechanism is seen in the fact that, though it prevents the actual revolving-shutter casing from being pulled up from the outside, yet it does not lock the revolving-shutter shaft against unauthorized turning.

Published West German Patent Application No. 282 5 059 discloses an automatic locking mechanism for a revolving shutter to protect it against unauthorized pulling up from the outside, in which an interlock of the revolving-shutter shaft is provided which is activated after the revolving-shutter casing is lowered. The design solution of this locking mechanism is the provision of an eccentric lever mounted on the outer surface of the end piece of the belt pulley, which eccentric lever, after the revolving-shutter casing is lowered, automatically meshes with an abutment located in the area of suspension of the revolving-shutter shaft, causing the latter to be locked against an upward motion of the revolving-shaft casing. The design solution further provides that the eccentric lever can be disengaged from the abutment by turning the belt pulley in the direction of upward motion of the revolving-shutter casing.

True, this automatic locking mechanism represents an advance in revolving-shutter design, which can also be used by subsequent installation in existing revolving shutter devices, but it is not equally well suited for all sizes and types of belt pulleys.

Therefore, it is a primary object of the invention to provide a simple automatic locking mechanism, which can be installed equally well into existing revolving-shutter devices and which will secure a revolving shutter against unauthorized pulling up from the outside. Through this design, the revolving-shutter shaft is secured against unauthorized turning and is equally well suited for belt pulleys of different design.

This object is achieved in the case of the automatic locking mechanism described in the introduction in that the insertion cap forming the pivot bearing for the revolving-shutter shaft is positively coupled with the belt pulley by means of a locking lever and the latter simultaneously meshes with the fixed bearing pin of the revolving-shutter shaft.

Therefore, the subject of the present invention is an automatic locking mechanism for a revolving shutter as set forth in the preamble to claim 1, characterized in that the belt pulley and the roller insertion cap engage with each other positively through a pivotable locking lever and the pivotable locking lever engages with a pin which is fixed with respect to the axis of rotation of the revolving-shutter casing after it is lowered completely, but it can also be used for setting other positions thereof.

One embodiment of the locking mechanism provides that an annular side web of the belt pulley engages positively with an appropriately placed and designed annular web on the roller insertion cap through a pivotable locking lever which, after the revolving-shutter case is lowered, engages with a pin which is fixed with respect to the axis of rotation of the revolving-shutter casing, and the side webs differ in diameter and interlock coaxially and have virtually coinciding gaps with different widths.

Other preferred embodiments of the physical design are described in the subclaims.

In the lowered state, in addition to the positive coupling between the belt pulley and the insertion cap of the revolving-shutter shaft, a positive coupling is established between insertion cap and belt pulley through a pivotable locking lever which, through its simultaneous engagement with the fixed bearing pin, clamps the revolving-shutter shaft against unwanted rotation. Unlocking occurs by initiating a slight rotation of the belt pulley with respect to the roller insertion cap through the belt band, thereby initiating a mutual displacement of the gaps in the side webs of the belt pulley and the insertion gap, with the result that the rim of the side web at the gap in the insertion cap acts on one lever arm of the pivotable locking lever, thus compensating the force of the spring and, by virtue of the pivoting action, disengages the other lever arm from the bearing pin or from the toothed wheel placed thereon. In order to produce this action, the side webs are properly arranged, coaxially with respect to one another, and have appropriately designed gaps with different widths spaced the proper distance from one another, through which extends one lever arm of the locking lever. As soon as the belt band exerts a pull on the belt pulley, the interlock is terminated. When the revolving-shutting casing is lowered, so that the belt on the belt pulley is essentially without tension, the gaps in the side webs are arranged in such a way with respect to one another that one lever arm of the rocking lever reaches through both side webs under the action of the spring and at the same time the other lever arm of the rocking lever brings about the engagement and positive coupling with the fixed bearing pin, so that the revolving-shutter shaft cannot rotate. True, an unauthorized torque acting on the revolving shaft results in a slight mutual displacement of the gaps in the side webs, but it does not terminate the interlock. The slight belt tension produced by a spring or similar device provided, say, in the belt winding box after the revolving shutter is lowered is not yet sufficient to initiate the unlocking process, although the belt is not completely relieved from tension. The unlocking process becomes possible only through a sufficient torque acting on the belt pulley when the revolving-shutter casing is pulled up.

For the unlocking process, the decisive factor is that, first of all, the edge of a cutout in the side web of the belt pulley acts on the locking lever, pivoting it in such a way that the gap edge of the side web of the roller insertion cap becomes engaged in such a way that the rocking lever remains swung out, the spring force acting oppositely and permanently on the rocking lever is compensated, and the other lever arm of the rocking lever is released from its interlocking engagement with the bearing pin as a result of the pivoting motion.

To prevent outside tampering with the belt pulley, a locking diaphragm may be provided on the side of the belt pulley turned towards the revolving-shutter casing. This locking diaphragm partly overlaps, or surrounds, the belt pulley.

In a preferred embodiment of the invention, the automatic locking mechanism for the revolving-shutter shaft as provided by the invention is combined with the automatic locking mechanism via the jacket of the revolving-shutter shaft as disclosed in West German Pat. No. 243 7 912. This preferred combination includes two possibilities. In the first possibility, additional locking of the revolving-shutter casing and/or the guide rail is achieved through one arm of a double-arm lever mounted within the revolving-shutter shaft. This lever can be moved out of the jacket of the revolving-shutter shaft through a gap in the jacket. In the second possibility disclosed in this West German patent, additional locking of the revolving-shutter casing is provided through one or more segments of the jacket of the revolving-shutter shaft, which are hinge-connected with one another in the axial direction such that when the revolving-shutter casing is lowered, they swing out of the circumferential line of the shaft.

Reference is made to West German Pat. No. 243 7 912 for details of this additional locking over the jacket of the revolving-shutter shaft, especially by means of a segment of the revolving-shutter shaft capable of swinging outwardly. This locking of the revolving-shutter casing prevents it from unwarranted pulling up into the space between revolving-shutter shaft and box wall of the revolving shutter.

The locking mechanism as provided by the present invention clamps the revolving-shutter shaft against unauthorized rotation. Through the preferred embodiment of both locking mechanisms, optimum locking of the revolving shutter against unwarranted pulling up is achieved. The particular advantage of the mechanical design as provided by the invention is seen in the fact that it can be installed at any time in existing revolving-shutter structures, that no extra space is required for this device, and that it quarantees a safe and reliable functioning. This locking mechanism needs no maintenance. Thus, the conventional forms of construction of the revolving-shutter shafts and other parts can be retained without modification when the locking mechanisms embodying the invention is installed. This results in considerable economic advantages, because no conversions are required in the production, stocking, and final assembly of the revolving shutters.

The locking mechanism for a revolving shutter against unauthorized pulling up as provided by the invention goes automatically into the locking position when the revolving-shutter casing is lowered. Therefore, it cannot be forgotten and can be counted on to perform its function. Installation of the locking mechanism according to the invention into new or existing revolving shutter devices therefore also has economic advantages, because possible intrusions into buildings that are provided with these devices are made more difficult or even prevented. The locking mechanism embodying the invention thus belongs to the domain of preventive measures against burglaries.

The invention will now be described in greater detail below with reference to the accompanying drawing, in which.

Figure 1:
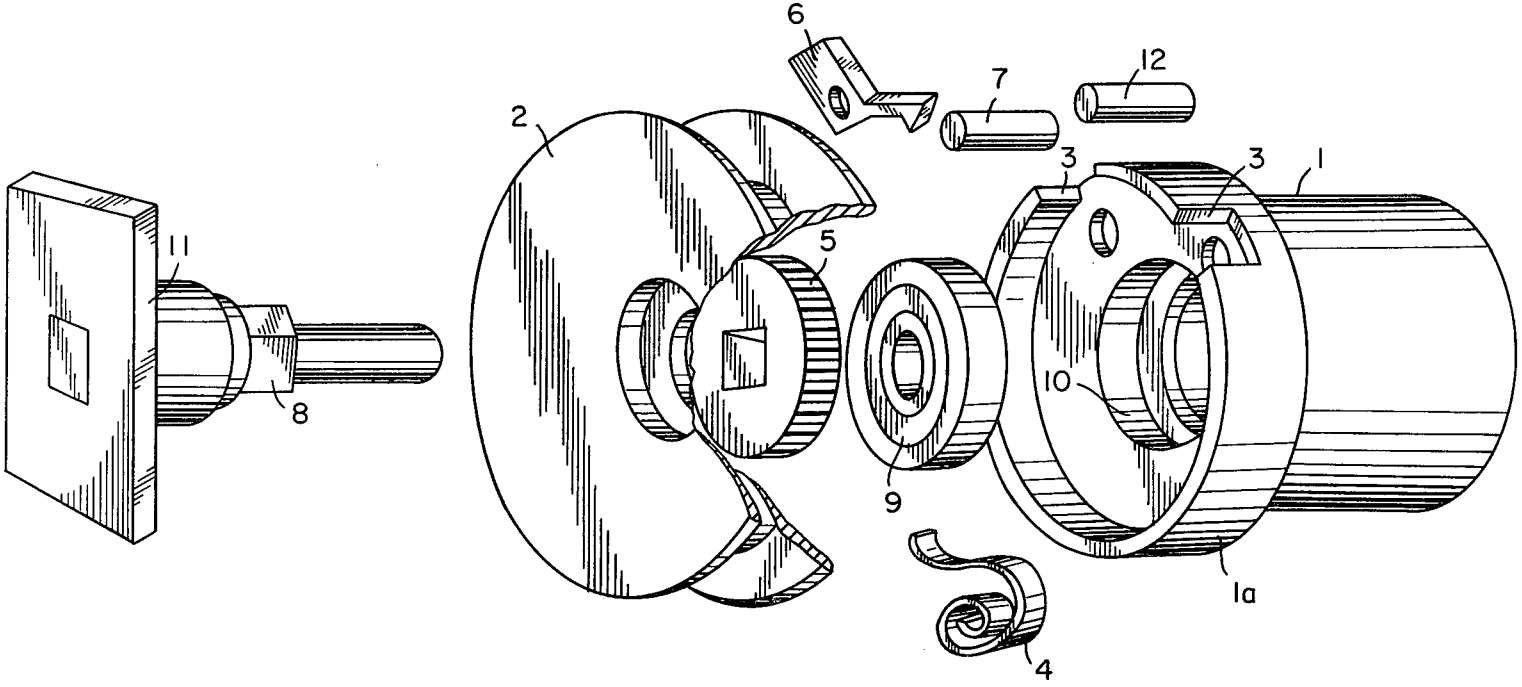
FIG. 1 is a perspective exploded view of the mechanical design of belt pulley and bearing cap.

FIG. 1 is a detailed exploded view of the mechanical design, as provided by the invention, of the roller insertion cap 1 insertable into the revolving-shutter roller, of the locking mechanism, of the belt pulley 2, and of the axle bearing of the revolving shutter in the left side of the figure. The axle bearing 11 proper has a plate which is fastened on the revolving-shutter casing or on a side wall, with a round bearing element for the belt pulley and for a fixed square pin connected thereto, the end of which is designed as a round cylinder. To the right is shown a cutaway portion of the belt pulley having the well-known design of a U-shaped profile for receiving the belt of the revolving shutter and having, on one side, a side web 2*a* designed with a smaller circumference than the belt pulley (not recognizable because of the perspective illustration). In its assembled state, the belt pulley is seated on the cylindrical bearing component of the axle bearing 11. Next to the belt pulley is shown the toothed wheel 5 which, in assembled state, is seated rigidly on the bearing pin 8 and which, in this embodiment, serves as an abutment for the locking lever 6. In a simplified design, the rocking lever acts directly on the pin 8 so as to produce the locking action. In this case, the pin has an appropriately designed engagement facility, e.g., a groove. The locking lever 6 is designed as a double-arm rocking lever, one lever arm of which has an appropriate serrated tip for engagement with the toothed wheel 5, and the other lever of which is designed so that it extends through the gaps 3 in the side webs 1*a* and 2*a*. The fulcrum for the locking lever 6 is the pin 7, which is fastened on the disk of the cap sleeve 10, but which is shown separately in the figure. The pivot bearing 9 proper is shown in the center of FIG. 1. In assembled state, it is seated in the cap sleeve 10 of the roller insertion cap 1. The roller insertion cap 1 has a shaft, which is inserted into the revolving-shutter shaft, to which is joined a cap sleeve 10 to receive the pivot bearing 9. The annular side web 1*a* with the two gaps 3 on the edge is attached on the end face of the plate. The diameter of the side web 1*a* is larger than that of the side web 2*a* of the belt pulley 2 and, after installation, it surrounds the side web 2*a* coaxially. However, it is also possible to design the size of the diameters inversely, so that 1*a* is smaller than 2*a* and is surrounded by the latter. The spring 4 is seated on the pin 12 placed in an appropriate hole in the plate of the roller insertion cap 1 in the assembled state.

By way of example, it is also possible to replace the toothed wheel 5 by an internally toothed wheel rim, which is positively locked on the axle bearing 11, with which engages an appropriately placed locking lever 6 so as to produce the interlock.

Figure 2:
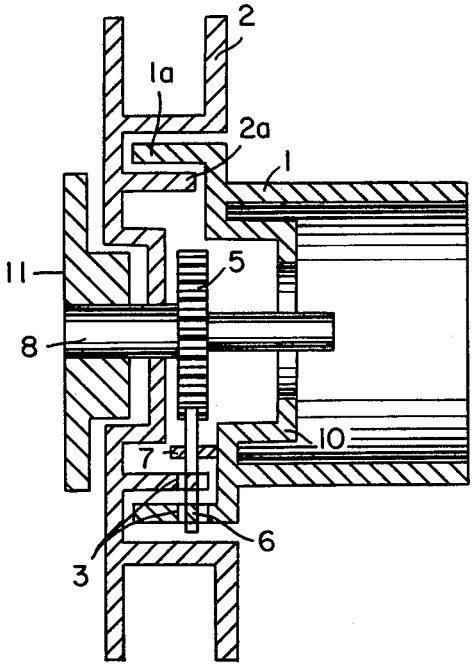
FIG. 2 is a cross-sectional view of the same parts in their assembled state.

FIG. 2 is a cross-sectional view of the mechanical design, as provided by the invention, of the belt pulley 2, the axle bearing 11, and the roller insertion cap 1, in their assembled state. The pin 8, on which is seated the toothed wheel 5, extends from the axle bearing 11, with the cylindrical end piece of the pin extending into the sleeve element of the roller insertion cap 1.

On the cylindrical end piece of the pin 8 is seated the pivot bearing 9 which, in this case, has been omitted for reasons of clarity, but which is normally placed in the cap sleeve 10. There is attached to the axle bearing 11 the belt pulley 2 with the side web 2*a* which is surrounded coaxially by the side web 1*a* of the roller insertion cap 1. The locking lever 6 is seated on the pin 7 and reaches through the holes 3 in the lateral webs 1*a* and 2*a*, thereby establishing the positive coupling between belt pulley and roller insertion cap.

Figure 3:
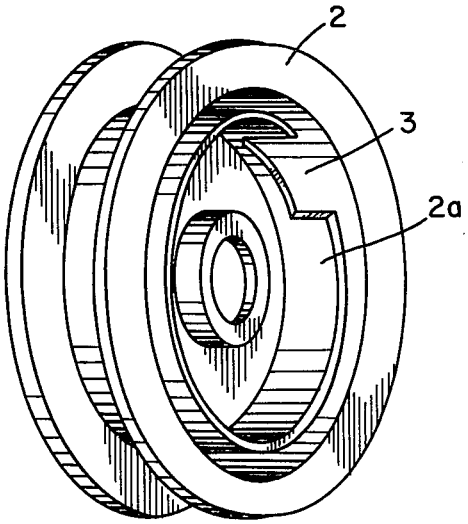
FIG. 3 is a view of the inside of the belt pulley.

FIG. 3 shows, from the other side, the belt pulley 2 which has already been shown in FIG. 1, so that the arrangement of the side web 2*a* with the gap 3 can be seen clearly.

Figure 4:
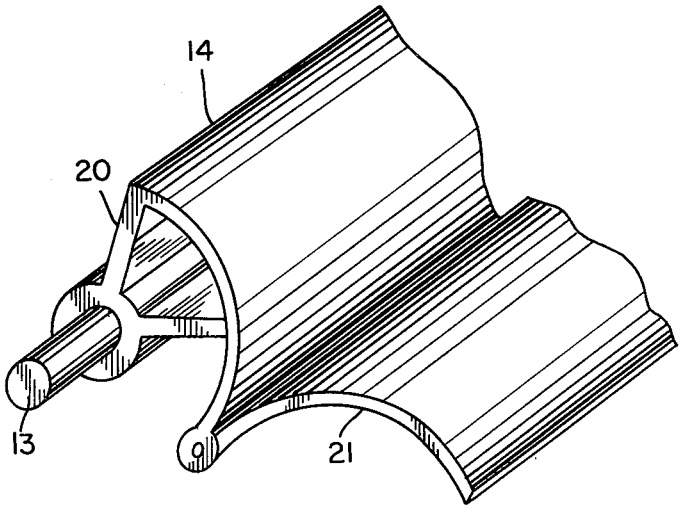
FIG. 4 is a perspective exploded view of a locking mechanism for the revolving-shutter casing as disclosed in West German Pat. No. 243 7 912.

FIG. 4 shows a device for locking the revolving-shutter casing with a swinging-out jacket which meshes with the revolving-shutter casing (not shown) and which produces an interlock in accordance with the mode of engagement described in West German Pat. No. 243 7 912. In this case, the form of construction of the jacket shown is through the revolving-shutter shaft 13 which is designed as a plug-and-socket connection and which is provided for engagement with the cylindrical portion of the roller insertion cap 1. The revolving-shutter shaft has a jacket 14 consisting of several segments. In the present case, the segment 20 is fixed and the segment 21 can swing out. Instead of one swinging-out segment 21, several may be provided. The revolving-shutter casing (not shown) is attached on the swinging-out segment 21. When the revolving-shutter casing is pulled up, the swinging-out segments of the jacket 14 make contact in a circular shape. When the revolving-shutter casing is pulled down, these segments preferably swing out at an obtuse angle, with the result that the radius of the jacket is increased and the outermost segment meshes with the revolving-shutter casing.

The double lock of the lowered revolving-shutter casing through the revolving-shutter shaft and the jacket of the revolving-shutter shaft in order to lock the casing proper provides excellent protection against the pulling up of the revolving-shutter casing from the outside.

The automatic locking mechanism for the revolving-shutter shaft embodying the invention consists of simple and inexpensive components, which can be installed easily. Customary high-strength materials, such as steel, aluminum, alloys, or plastics are used to fabricate these parts. The design and arrangement, as provided by the invention, of the belt pulley have the special advantage that the width and the diameter of the belt pulley can be selected according to the special requirements and, in principle, all customary sizes of known belt pulleys can be equipped with the extra side web, so that the device as provided by the invention can be used for revolving shutters and roller gates of different designs.

I claim:

1. An automatic locking device for a revolving shutter to protect it against unauthorized pulling up from the outside by means of a locking device which is moved into its locking position after the revolving-shutter casing has been lowered, wherein there are provided:

a belt pulley and a roller insertion cap;

a lateral axle bearing having a round bearing element mounting said pulley for rotating movement with respect thereto and having a fixed square bearing pin connected thereto and the end of which is designed as a round cylinder;

a locking lever pivotably mounted on said roller insertion cap;

said belt pulley and said roller insertion cap each having an annular side web, said side webs having different diameters and overlapping each other coaxially, and each having coinciding gaps through which the pivotable locking lever engages positively;

in the lowered state of said revolving-shutter casing, the pivotable locking lever engaging, at least indirectly, with the bearing pin which is fixed with respect to the axis of rotation of said revolving-shutter casing; and said coinciding gaps having different widths so as to facilitate unlocking upon a slight rotation of the belt pulley with respect to the roller insertion cap.

2. The locking mechanism as set forth in claim 1, wherein said locking lever engages with a toothed wheel arranged on said fixed bearing pin.

3. The locking mechanism as set forth in claim 1 or 2, wherein said pivotable lever is caused to engage with said fixed toothed wheel by means of a spring provided in or on said roller insertion cap.

4. The locking mechanism as set forth in claim 3, wherein said spring is a leaf spring which is seated on a pin parallel to the axis of rotation and provided in said roller insertion cap and acting on said locking lever.

5. The locking mechanism as set forth in claim 1 wherein said pivotable locking lever is designed as a rocking lever and is seated on a pin parallel to said axis of rotation of said revolving-shutter casing and provided in said insertion cap, and engages in gaps of said annular side webs, of said belt pulley and of said roller insertion cap.

6. The locking mechanism as set forth in claim 1, wherein said roller insertion cap is designed as a pivot bearing for the revolving-shutter shaft.

* * * * *